US005562213A

United States Patent [19]

Wile

[11] Patent Number: 5,562,213

[45] Date of Patent: Oct. 8, 1996

[54] BAG DISPENSING SYSTEM AND RACK

[75] Inventor: Richard M. Wile, Medfield, Mass.

[73] Assignee: BPI Packaging Technologies, Inc., North Dighton, Mass.

[21] Appl. No.: 289,123

[22] Filed: Aug. 11, 1994

[51] Int. Cl.[6] ..... B65D 85/62; A63B 55/04; B65B 67/04

[52] U.S. Cl. ..... 206/554; 248/97; 248/99; 248/153

[58] Field of Search ..... 206/554; 383/7, 383/9, 37; 248/100, 99, 101, 95, 97, 153, 302, 133

[56] References Cited

U.S. PATENT DOCUMENTS

| | | | |
|---|---|---|---|
| 4,062,170 | 12/1977 | Orem . | |
| 4,858,862 | 8/1989 | Prader | 248/99 |
| 5,014,944 | 5/1991 | Malik et al. | 248/99 |
| 5,092,548 | 3/1992 | Bayes et al. | 248/99 |
| 5,190,253 | 3/1993 | Sable | 248/99 |
| 5,303,889 | 4/1994 | Malik et al. | 248/97 |
| 5,307,935 | 5/1994 | Kemanjian | 206/554 |

FOREIGN PATENT DOCUMENTS

| | | |
|---|---|---|
| 1126701 | 6/1982 | Canada . |

*Primary Examiner*—Bryon P. Gehman
*Attorney, Agent, or Firm*—Henry D. Pahl, Jr.

[57] ABSTRACT

A stack of T-shirt type plastic film bags having handles extending from an openable mouth are formed into a pack by bonding together bridging strips extending between the handles. A dispensing rack includes a frame providing an upper horizontal edge over which the bag handles are draped. The bridging strips are hooked over and retained by a relatively wide tongue extending rearward from a point on the frame below the horizontal edge.

8 Claims, 3 Drawing Sheets

BAG DISPENSING SYSTEM AND RACK

BACKGROUND OF THE INVENTION

The present invention relates to a system for dispensing T-shirt type plastic film carry bags from a pack and, more particularly, to such a system which provides effective control of the handles extending from the bag mouth prior to and during withdrawal of individual bags from the pack.

Many systems have been devised for dispensing so-called T-shirt type plastic carry bags. Examples of such systems are disclosed in U.S. Pat. Nos. 4,676,378; 4,877,473; and 5,332,097.

A recurring problem in the dispensing of T-shirt type plastic bags is in controlling the handles prior to and during dispensing. As is understood, the plastic film typically used for the manufacture of T-shirt type bags is relatively slippery and, since the handles are generally elongate, they can easily fall out of alignment with each other if not somehow constrained. Typically, some sort of constraint is necessary both to facilitate mounting of a pack of bags on a dispensing rack and to keep the handles from becoming disarrayed even while they are on the rack.

Among the several objects of the present invention may be noted the provision of a novel and useful system for dispensing T-shirt type plastic film bags; the provision of such a system which maintains the handles of the T-shirt bags in alignment prior to and during dispensing; the provision of such a system which facilitates the easy manual removal of single bags from a pack; the provision of such a system which is highly reliable and which is of relatively simple and inexpensive construction. Other objects and features will be in part apparent and in part pointed out hereinafter.

SUMMARY OF THE INVENTION

In accordance with the present invention, bags are dispensed from a pack of the type comprising a stack of T-shirt type plastic film bags having an openable mouth with loop handles extending on either side of the mouth, the handles being linked by a tearaway bridging strip extending between them. The pack is received on a frame providing an elongate horizontal edge over which the linked handles of the pack of bags may be draped. A relatively wide tongue extends rearwardly from the frame substantially below the horizontal edge for retaining the bridging strips of the bags in the pack. Individual bags may be removed from the front of the frame severing the handles from the respective bridging strip.

Preferably, the bags are provided with a mounting tab extending from the mouth of the bag between the handles and providing an aperture which is received on a narrow tongue extending upwardly and rearwardly from the middle of the horizontal frame edge. The tab is slit across a majority of its width below the mounting aperture so as to be easily separable from the bag as it is removed from the frame. The slit preferably includes a central arched portion which provides a tab which is easily grasped by a user for withdrawing a bag from the pack. Preferably also, the frame provides a projection extending downwardly and forward so that the arched portion of the panel below the slit is extended toward and easily grasped by a user of the bags.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
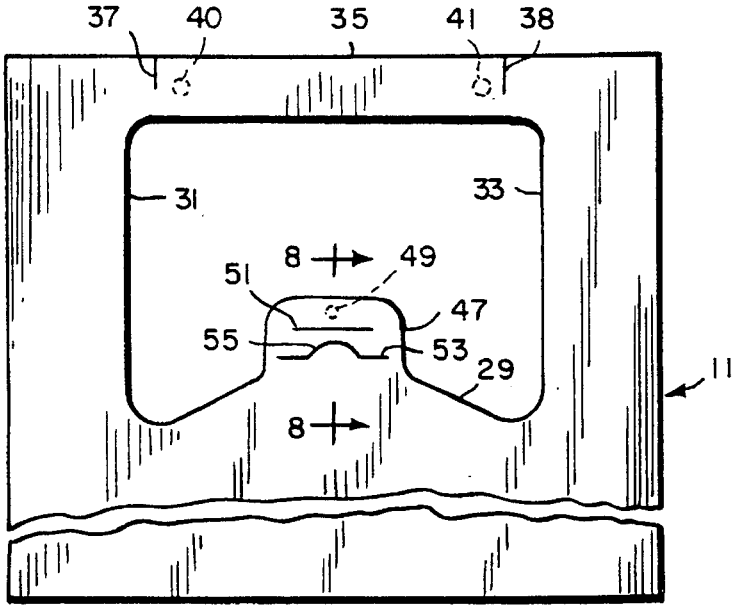
FIG. 1 is a plan view of a pack of T-shirt type plastic film bags adapted for dispensing in accordance with the practice of the present invention.

Referring now to FIG. 1, the bag pack employed in the system illustrated comprises a stack of T-shirt type plastic film bags 11. The bags may be conventionally formed from a gussetted tube of a suitable plastic film which is heat sealed at intervals to close off the tube at each end of a section constituting a single bag. After the heat seals are made, the individual bag blanks are separated and stacked. Then a central cutout is made which creates an openable bag mouth 29 and leaves handle portions 31 and 33, respectively, on either side of the mouth.

In accordance with one aspect of the present invention, a tearaway bridging strip 35 is left between the handle portions 31 and 33, the strip being partially cut through at each end, as indicated by reference characters 37 and 38, so that the bags be easily torn away from the bridging strip during dispensing. The bridging strips are preferably, though not necessarily, located at the extremities of the handles, as illustrated in the particular embodiment being disclosed. The bridging strips 35 are preferably bonded together, e.g. by the application of hot pins as known in the art, so as to form the bags into a pack of convenient number, typically fifty. In FIG. 1, the bonding points are indicated by reference characters 40 and 41.

Preferably, the central cutout is shaped so as to also provide a central mounting tab 47 extending from the panels which form the bag mouth. The tab portions 47 of the bags in the stack are likewise bonded together by the application of a heated pin near the upper edge of the mounting tabs, this bond point being indicated by reference character 49.

The central mounting tabs 47 are also provided with slits or apertures 51 which are adapted to receive a mounting tongue or hook as described in greater detail hereinafter. Further, below the slits 51, a second slit 53 is provided which extends almost completely across the entire width of the tab 47, i.e. so as to leave only easily severable portions at either end of the slit. Slit 53 also includes an arched central portion, designated by reference character 55, which provides an easily grasped tab which allows a user to get a hold of the front face of the top bag in a bag pack and draw it away from the pack breaking the easily severable portions.

Figure 2:
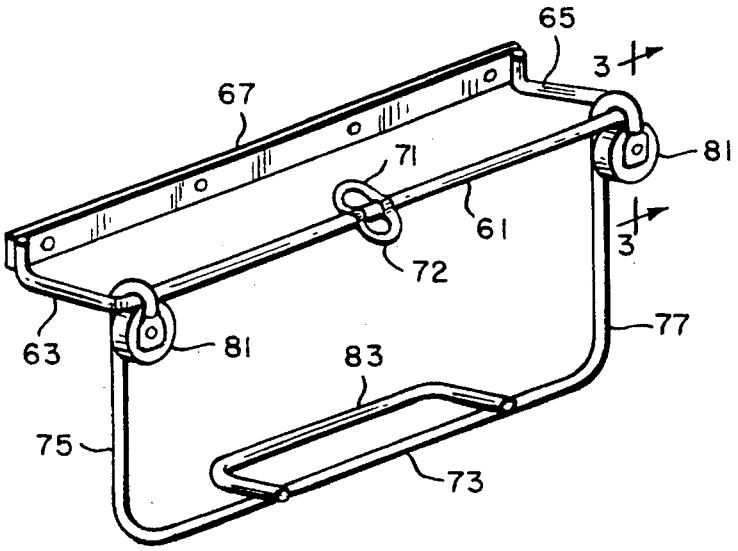
FIG. 2 is a perspective view of a two part rack for receiving a pack of the type illustrated in FIG. 1 and for dispensing bags therefrom.
Figure 3:
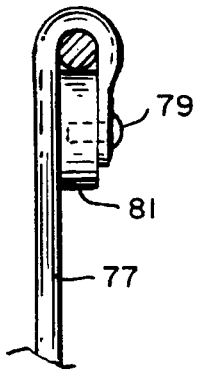
FIG. 3 is a sectional view showing the attachment of the two parts.
Figure 4:
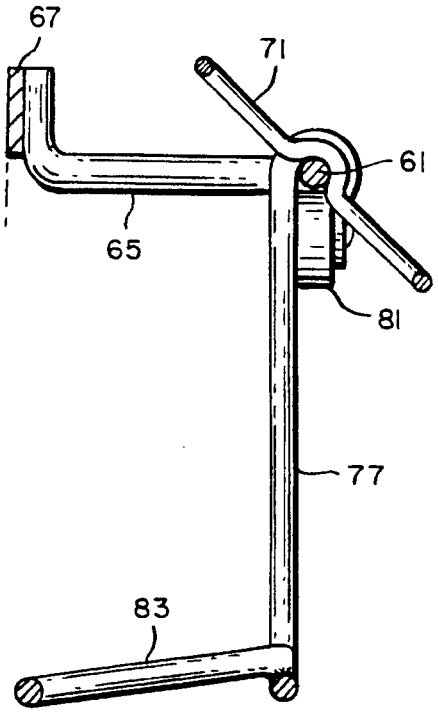
FIG. 4 is a side view in section through the center of the rack.

Referring now to FIGS. 2–5, there is illustrated a two-part, bent wire frame which provides a dispensing rack for receiving a pack of bags of the type illustrated in FIG. 1. As illustrated in FIG. 2, the frame is oriented for mounting against a wall, although it is also adapted for mounting under a counter as is described hereinafter. The first part of the frame involves a rod bent into a shallow U-shape providing a horizontal run 61, which is wider than the bags of FIG. 1, with short legs 63 and 65 extending rearward. As is described in greater detail hereinafter, horizontal run 61 provides an edge over which the bag handles may be draped. The ends of the legs 63 and 65 are turned up and welded to a mounting plate 67 which is apertured to allow the frame to be fastened to a wall with suitable screws.

Midway along the horizontal run 61 is a wire loop which is welded to the run 61 so as to provide a first tongue portion or hook 71 which extends rearwardly and upwardly, e.g. at an angle of about 45 degrees. This is the tab or hook which can be received in the mounting apertures or slits 51 in the central mounting tabs on the bags described earlier. This wire loop also provides a second and similar tab portion 72 which extends downwardly and forwardly, in essence complementing the tab 71. As will be understood, the wire loop will be omitted from the rack if the mounting tabs 47 are omitted from the bags.

For the second part of the frame, a second formed rod piece is employed to provide a horizontal run 73 with upwardly extending legs 75 and 77. Legs 75 and 77 terminate in hook-like portions which hang over the horizontal run 61 of the first frame part. To retain the second frame part on the first frame part, the end of each hook portion is apertured, as illustrated, and a screw 79 can be inserted into a rubber washer or block 81 which closes the hook opening.

Mounted centrally on the horizontal run 73, i.e. at a point below the horizontal edge or run 61, is welded a U-shaped bent wire section which provides a wide tab or tongue 83 which extends rearwardly and slightly downwardly.

Figure 5:
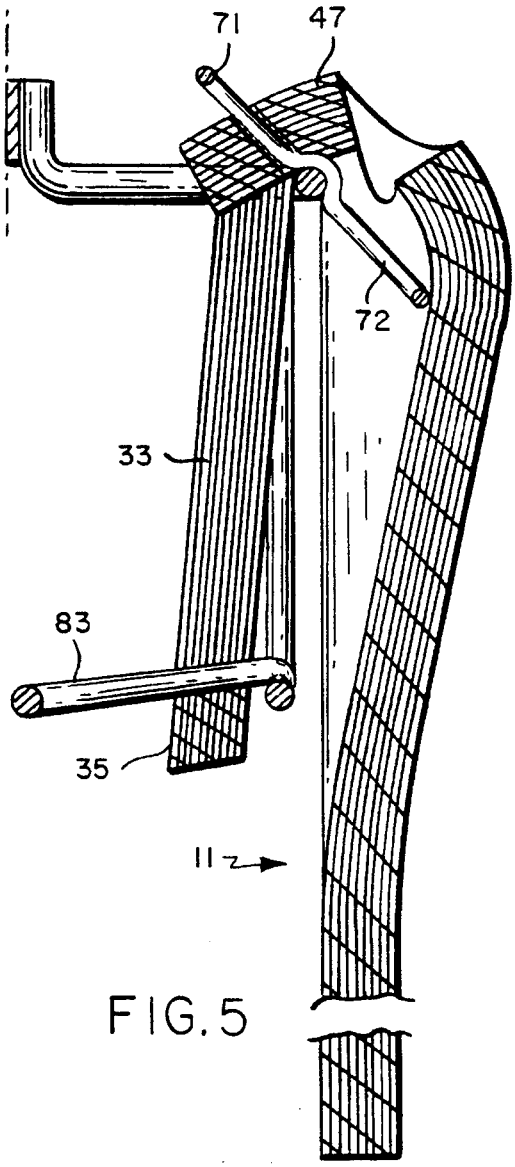
FIG. 5 is a view similar to FIG. 1 showing the rack with a pack of bags mounted thereon.
Figure 8:
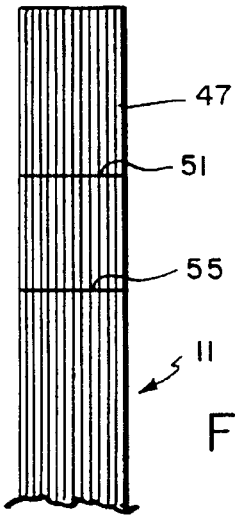
FIG. 8 is a side view in section of mounting tabs used in the bags in the pack of FIG. 1, prior to mounting on the rack, and taken substantially on the line 8—8 of FIG. 1.
Figure 7:
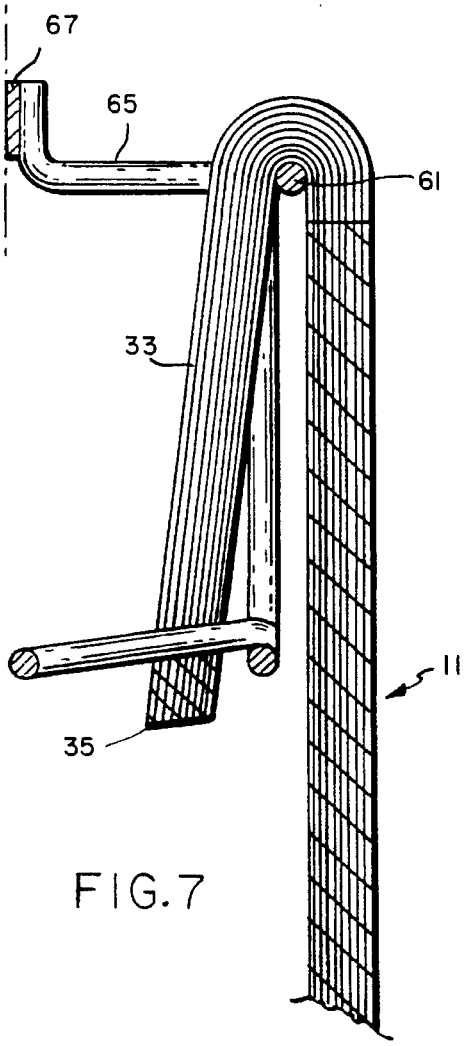
FIG. 7 is a side view in section taken substantially on the line 7—7 of FIG. 6.
Figure 6:
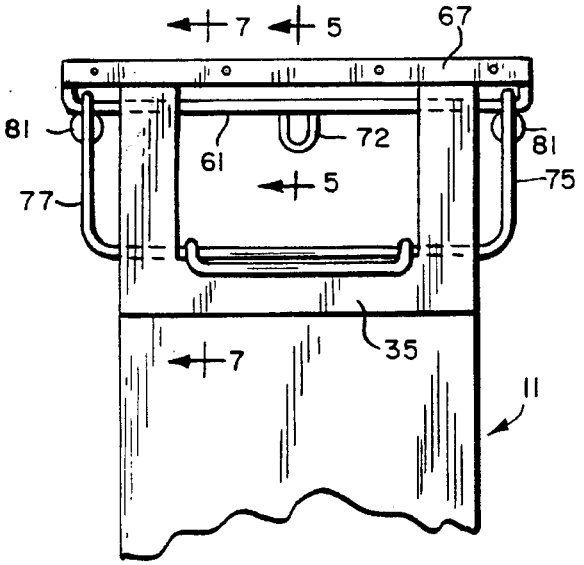
FIG. 6 is a view from the rear of the rack and pack of FIG. 5, showing the manner in which the bag handles are retained.

FIG. 5 shows the rack of FIG. 2 loaded with a pack of bags of the type illustrated in FIG. 1. To load the bag pack on the rack, the tabs 47 are placed over the rack with the wire tongue or tab 71 extending through the mounting apertures 51. The bag handles, together with the bridging strips 35, are then flipped over the horizontal run 61 and the bridging strips are pushed down and over so as to catch under the broad wire tab 83 as is illustrated in FIGS. 5–7.

It can thus be seen that the horizontal run 61 thus provides an edge over which the handles may be draped while the wire tab 83 below the edge retains the bridging strips and thus constrains the extremities of the bag handles. As will be appreciated, a very neat and controlled appearance is presented.

While the tab 71 retains the mouth portions of the bags in the pack by engaging the slits 51 in the central mounting tabs 47, the complementary tab 72 pushes the portions of the bag face panels forwardly so that the arched portions 55 of the slits 53 are projected outwardly away from the central mounting tabs and thus can be easily grasped by a user. Accordingly, to remove a bag from the dispenser rack, the user merely grasps the arched portion 55 and draws the bag face upwardly and away from the rack. As the bag is drawn away, the handles will separate from the bridging strips at the slits 37 and 38. When the last bag is removed, the remaining bridge strips will merely drop away as a unit as opposed to having a multiplicity of small torn pieces of plastic film.

Figure 9:
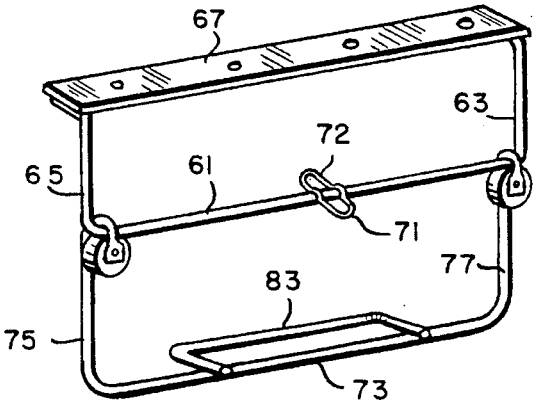
FIG. 9 is a view similar to FIG. 2 but showing another orientation of the rack.

As indicated previously, the frame may also be mounted under a counter. Such an arrangement is illustrated in FIG. 9. In this orientation, the upper piece of the rack is reversed right to left as well as being oriented with the legs 65 and 67 extending upwards. The roles of the wire tabs 71 and 72 are thus effectively reversed as will be apparent to those skilled in the art.

In view of the foregoing it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. A rack for dispensing bags from a pack of the type comprising a stack of T-shirt type plastic film bags having a mouth and loop handles extending on either side of the mouth, the handles being linked by a tearaway bridging strip extending between them substantially at their extremities, said rack comprising:

a frame providing an elongate horizontal edge over which said handles of the pack of bags may be draped;

a relatively wide tongue extending rearwardly and substantially horizontally from said frame at a position which is a substantial distance below said edge for retaining the tearaway strips of a bag pack whose handles are draped across said edge.

2. A rack for dispensing bags from a pack of the type comprising a stack of T-shirt type plastic film bags having an openable mouth and loop handles extending on either side of the mouth, the handles being linked by a transverse tearaway strip extending between them substantially at their extremities, there being a mounting tab extending upwardly from the mouth edge between the handles, said mounting tab including a mounting aperture and, below said aperture, a slit extending across a majority of said tab leaving easily severable portions on either side, said rack comprising:

a frame providing an elongate horizontal edge over which said handles of the pack of bags may be draped;

a relatively narrow tongue extending from about the middle of said edge for receiving the apertures in said mounting tabs;

a relatively wide tongue extending rearwardly and substantially horizontally from said frame at a position which is a substantial distance below said edge for retaining the tearaway strips of a bag pack whose handles are draped across said edge.

3. A rack as set forth in claim 2 wherein said narrow tongue extends upwardly and rearwardly from said edge.

4. A rack as set forth in claim 3 further comprising a complementary tongue projecting downwardly and forwardly from said edge opposite the first said narrow tongue.

5. A rack for dispensing bags from a pack of the type comprising a stack of T-shirt type plastic film bags having a mouth and loop handles extending on either side of the mouth, the handles being linked at their extremities by a tearaway strip extending between them, there being a mounting tab extending upwardly from the mouth edge between the handles, said mounting tab including a mounting aperture and, below said aperture, a slit extending across a majority of said tab leaving easily severable portions on either side, said rack comprising:

a first horizontal bar terminating in transversely extending legs which terminate in mounting means for attaching the frame to a structure;

mounted centrally on said first horizontal bar, a relatively narrow tongue extending obliquely to said legs for receiving said mounting apertures;

a second horizontal bar provided with means for mounting said second bar spaced below said first bar and essentially parallel thereto; and mounted centrally on said second bar, a relatively wide tongue extending rearwardly and substantially horizontally from said frame at a position which is a substantial distance below said edge for retaining the tearaway strips of a bag pack whose handles are draped across said first horizontal bar.

6. A bag dispensing system comprising:

a bag pack of the type comprising a stack of T-shirt type plastic film bags having a mouth and loop handles extending on either side of the mouth, the handles being linked by a tearaway bridging strip extending between them substantially at their extremities; and a frame providing an elongate horizontal edge over which the handles of said pack of bags are draped and a relatively wide tongue extending rearwardly and substantially horizontally from said frame at a position which is a substantial distance below said edge for retaining the tearaway strips of said bag pack.

7. A bag dispensing system comprising:

a bag pack of the type comprising a stack of T-shirt type plastic film bags having an openable mouth and loop-handles extending on either side of the mouth, the handles being linked at their extremities by a tearaway bridging strip extending between them, there being a mounting tab extending upwardly from each mouth edge between the handles, said mounting tab including a mounting aperture and, below said aperture, a slit extending across a majority of said tab leaving easily severable portions on either side;

a frame providing an elongate horizontal edge over which the handles of said pack of bags are draped;

a relatively narrow tongue extending upwardly and rearwardly from the middle of said edge for receiving the apertures in said mounting tabs;

a relatively wide tongue extending rearwardly and substantially horizontally from said frame at a position which is a substantial distance below said edge for retaining the tearaway strips of said bag pack.

8. A bag dispensing system as set forth in claim 7 further comprising a complementary tongue projecting downwardly and forwardly from said edge opposite the first said narrow tongue.

* * * * *